US011171453B2

(12) United States Patent
Chen

(10) Patent No.: US 11,171,453 B2
(45) Date of Patent: Nov. 9, 2021

(54) ELECTRICAL CONNECTOR WITH GROUNDING STRUCTURE AND SHIELDING

(71) Applicant: ACES ELECTRONICS CO., LTD., Taoyuan (TW)

(72) Inventor: Chun-Yuan Chen, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 0 days.

(21) Appl. No.: 16/896,692

(22) Filed: Jun. 9, 2020

(65) Prior Publication Data

US 2021/0006017 A1 Jan. 7, 2021

(30) Foreign Application Priority Data

Jul. 3, 2019 (TW) ..... 108208660

(51) Int. Cl.

| | |
|---|---|
| ***H01R 13/6586*** | (2011.01) |
| ***H01R 13/6596*** | (2011.01) |
| ***H01R 12/71*** | (2011.01) |
| *H01R 13/6581* | (2011.01) |
| *H01R 13/6593* | (2011.01) |
| *H01R 13/6594* | (2011.01) |
| *H01R 13/6595* | (2011.01) |

(Continued)

(52) U.S. Cl.

CPC ..... *H01R 13/6586* (2013.01); *H01R 12/716* (2013.01); *H01R 13/6596* (2013.01); *H01R 12/52* (2013.01); *H01R 12/7082* (2013.01); *H01R 12/712* (2013.01); *H01R 12/73* (2013.01); *H01R 13/6485* (2013.01); *H01R 13/658* (2013.01); *H01R 13/6581* (2013.01); *H01R 13/6582* (2013.01); *H01R 13/6591* (2013.01); *H01R 13/6593* (2013.01); *H01R 13/6594* (2013.01); *H01R 13/6595* (2013.01); *H01R 24/60* (2013.01); *H01R 2107/00* (2013.01)

(58) Field of Classification Search

CPC ..... H01R 13/6586; H01R 13/6596; H01R 12/716; H01R 13/6582; H01R 13/6594; H01R 24/60; H01R 2107/00; H01R 12/52; H01R 12/7082; H01R 12/73; H01R 13/658; H01R 13/6581; H01R 12/712; H01R 13/6485; H01R 13/6591; H01R 13/65914; H01R 13/6593; H01R 13/6595

USPC ..... 439/74

See application file for complete search history.

(56) References Cited

U.S. PATENT DOCUMENTS

2005/0287839 A1* 12/2005 Wang ..... H01R 13/10 439/74

2009/0253298 A1* 10/2009 Kameyama ..... H01R 12/724 439/607.41

* cited by examiner

*Primary Examiner* — Abdullah A Riyami

*Assistant Examiner* — Justin M Kratt

(74) *Attorney, Agent, or Firm* — Muncy, Geissler, Olds & Lowe, P.C.

(57) ABSTRACT

An electrical connector grounding structure includes an electrically insulative terminal holder block having a rectangular base, a mating structure and a fixing structure, conducting terminals positioned in the rectangular base with contact tips thereof extended to the mating structure and connection tips thereof bonded to a predetermined circuit board, a grounding member having a first contact structure, a positioning structure positioned in the fixing structure and a bonding structure bonded to the circuit board, and a shielding shell covering the electrically insulative terminal holder block and having a second contact structure set in contact with the first contact structure to form a ground loop (Continued)

that guides out electromagnetic waves and crosstalk interference generated during signal transmission.

9 Claims, 8 Drawing Sheets

(51) Int. Cl.

| | |
|---|---|
| *H01R 12/73* | (2011.01) |
| *H01R 24/60* | (2011.01) |
| *H01R 13/6582* | (2011.01) |
| *H01R 12/52* | (2011.01) |
| *H01R 13/6591* | (2011.01) |
| *H01R 12/70* | (2011.01) |
| *H01R 13/648* | (2006.01) |
| *H01R 107/00* | (2006.01) |
| *H01R 13/658* | (2011.01) |

ELECTRICAL CONNECTOR WITH GROUNDING STRUCTURE AND SHIELDING

CROSS-REFERENCE TO RELATED APPLICATION

This application claims the priority benefit of Taiwan patent application number 108208660, filed on Jul. 3, 2019.

BACKGROUND OF THE INVENTION

1. Field of the Invention

The present invention relates to electrical connector technology, and more particularly to an electrical connector grounding structure, which uses a grounding member on the electrical connector in contact with a shielding shell to form a ground loop, so that when the multiple conducting terminals of the electrical connector transmit high-frequency signals, the noise can be exported to the circuit board through the grounding member to effectively suppress or filter out electromagnetic wave interference and crosstalk interference, thereby improving the stability of the overall signal transmission.

2. Description of the Related Art

Today's technology is developing rapidly, and various electronic devices are constantly evolving. Among them, various electronic components are provided in different electronic devices and electrically connected to each other, so that electronic signals can be transmitted, calculated, or processed through the electronic components to complete various functions of the electronic devices.

In the aforementioned electronic devices, the board-to-board connector technology used to transmit electronic signals between two circuit boards is widely used. The female connector or male connector of the aforementioned board-to-board connector mostly has an insulative electrically insulative terminal holder block, and the insulative electrically insulative terminal holder block is provided with a mating structure (e.g., it is a plug-in slot for female connector, or a tongue plate for male connector), and a plurality of transmission terminals are inserted into the mating structure and extended out of the bottom of the electrically insulative terminal holder block. In actual application, the plural transmission terminals at the bottom of the insulative electrically insulative terminal holder block are soldered to the circuit board, so that the circuit layout on the circuit board is electrically connected to each transmission terminal. In this way, the corresponding types of board-to-board connectors are installed on the two circuit boards, so that the circuit layouts on the two circuit boards are electrically connected to each other by the mutual insertion of the two board-to-board connectors for enabling the electronic device to transmit electronic signals when in use.

However, with the increase in the transmission speed of electronic signals in various electronic devices today, the high-frequency transmission impedance of each transmission terminal in the board-to-board connector when transmitting electronic signals also increases, so that when transmitting electronic signals, it will produce electromagnetic interference (EMI) and crosstalk interference, resulting in unstable and abnormal electronic signal transmission quality, which cannot perform functions normally.

Therefore, how to reduce the high-frequency transmission impedance, electromagnetic waves and crosstalk interference of board-to-board connectors for transmitting electronic signals is the direction of improvement for the relevant manufacturers in this industry.

SUMMARY OF THE INVENTION

The present invention has been accomplished under the circumstances in view. It is therefore the main object of the present invention to provide an electrical connector grounding structure, which comprises an electrically insulative terminal holder block, a plurality of conducting terminals, a grounding member, and a shielding shell. The electrically insulative terminal holder block comprises a rectangular base, a mating structure located on the rectangular base, and a fixing structure located on the rectangular base around the mating structure. The conducting terminals are positioned in the rectangular base of the electrically insulative terminal holder block, each having a contact tip located at one end thereof and extended to the mating structure and a connection tip located at an opposite end thereof and extended out of the electrically insulative terminal holder block for bonding to a predetermined circuit board. The grounding member is mounted on the electrically insulative terminal holder block, comprising a first contact structure, a positioning structure positioned in the fixing structure of the electrically insulative terminal holder block and a bonding structure located at a bottom side thereof for bonding to the predetermined circuit board. The shielding shell comprises an accommodation open chamber that accommodates the electrically insulative terminal holder block, an opening longitudinally formed in the accommodation open chamber for the passing of the mating structure, and a second contact structure set in contact with the first contact structure. Because the grounding member is in contact with the shielding shell to form a common ground loop, when the conducting terminals transmit high-frequency signals, the shielding shell will form a good shielding effect. Through the bonding structure of the grounding member, the noise filtering is exported to the circuit board to improve the overall grounding, thereby effectively suppressing or filtering the electromagnetic wave interference and crosstalk interference generated during signal transmission and making the overall signal transmission more stable and reliable.

It is another object of the present invention to provide an electrical connector grounding structure, wherein the first contact structure of the grounding member comprises a plurality of convex contact points respectively positioned in respective contact grooves of the second contact structure of the shielding shell to improve the stability during contact, and thus achieving the purpose of increasing the stability of the grounding quality.

It is still another object of the present invention to provide an electrical connector grounding structure, wherein the shielding shell further comprises an inner shell that has a plurality of contact pieces respectively extended from opposing front and back sides of a bottom wall thereof. When the shielding shell is assembled on the electrically insulative terminal holder block, the contact pieces of the inner shell are kept in contact with the shielding shell to form a common ground loop that improves the path and density of ground conduction to effectively guide out the electromagnetic wave interference and crosstalk interference generated during signal transmission, thereby making the overall signal transmission more stable and reliable.

It is still another object of the present invention to provide an electrical connector grounding structure, wherein when the female electrical connector and the male electrical connector are connected together, the inner shell of the shielding shell of the female electrical connector is kept in contact with the contact components of the shielding shell of the male electrical connector to form a ground loop that improves the path and density of ground conduction to effectively guide out the electromagnetic wave interference and crosstalk interference generated during signal transmission, thereby making the overall signal transmission more stable and reliable.

It is still another object of the present invention to provide an electrical connector grounding structure, wherein the shielding shell completely covers the connection tips of the conducting terminals to form a good shielding effect of effectively suppressing or filtering the electromagnetic wave interference and crosstalk interference generated during signal transmission, thereby achieving the purpose of improving the overall signal transmission stability.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
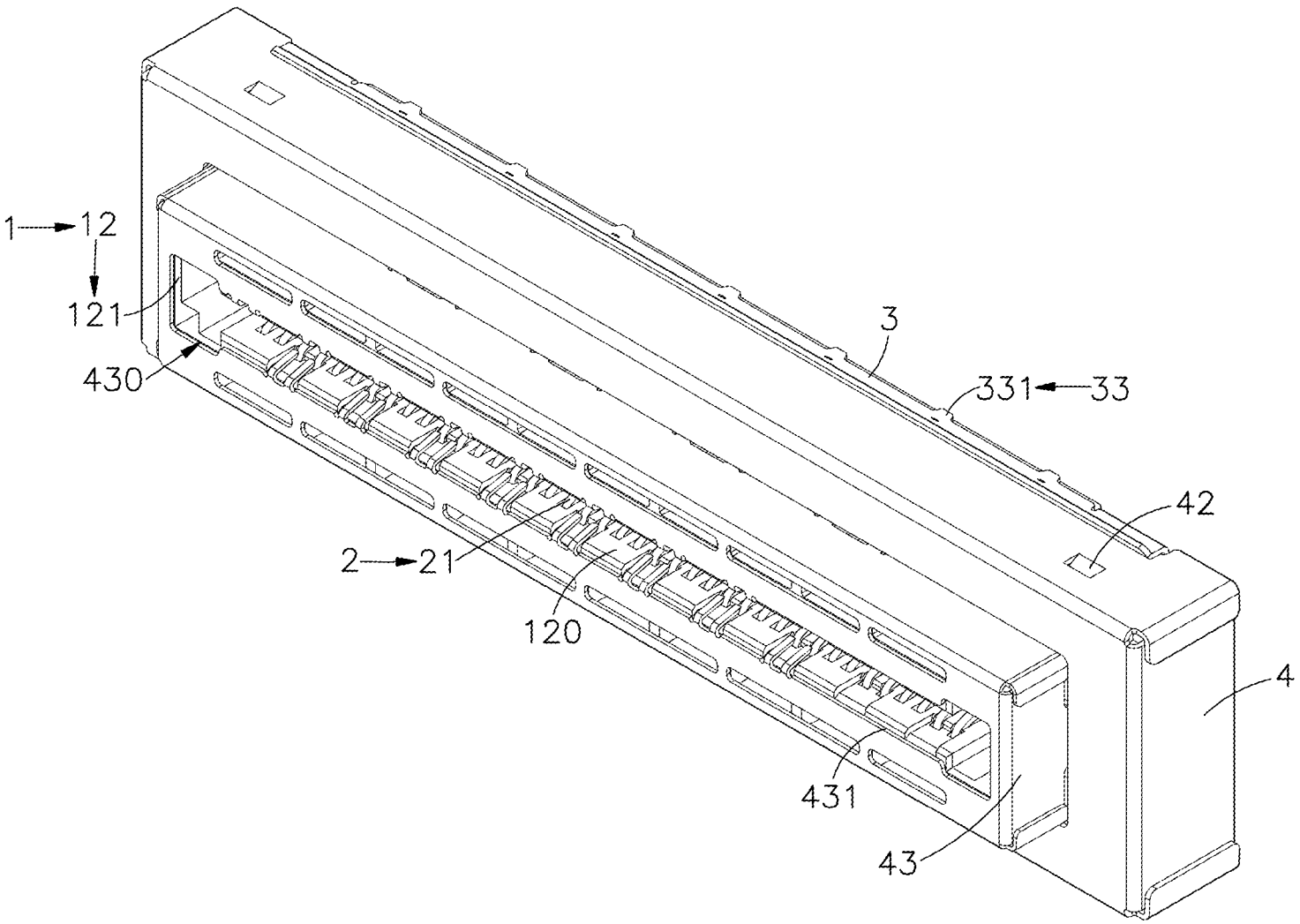
FIG. 1 is an oblique top elevational view electrical connector grounding structure in the form of a female electrical connector in accordance with the present invention.
Figure 2:
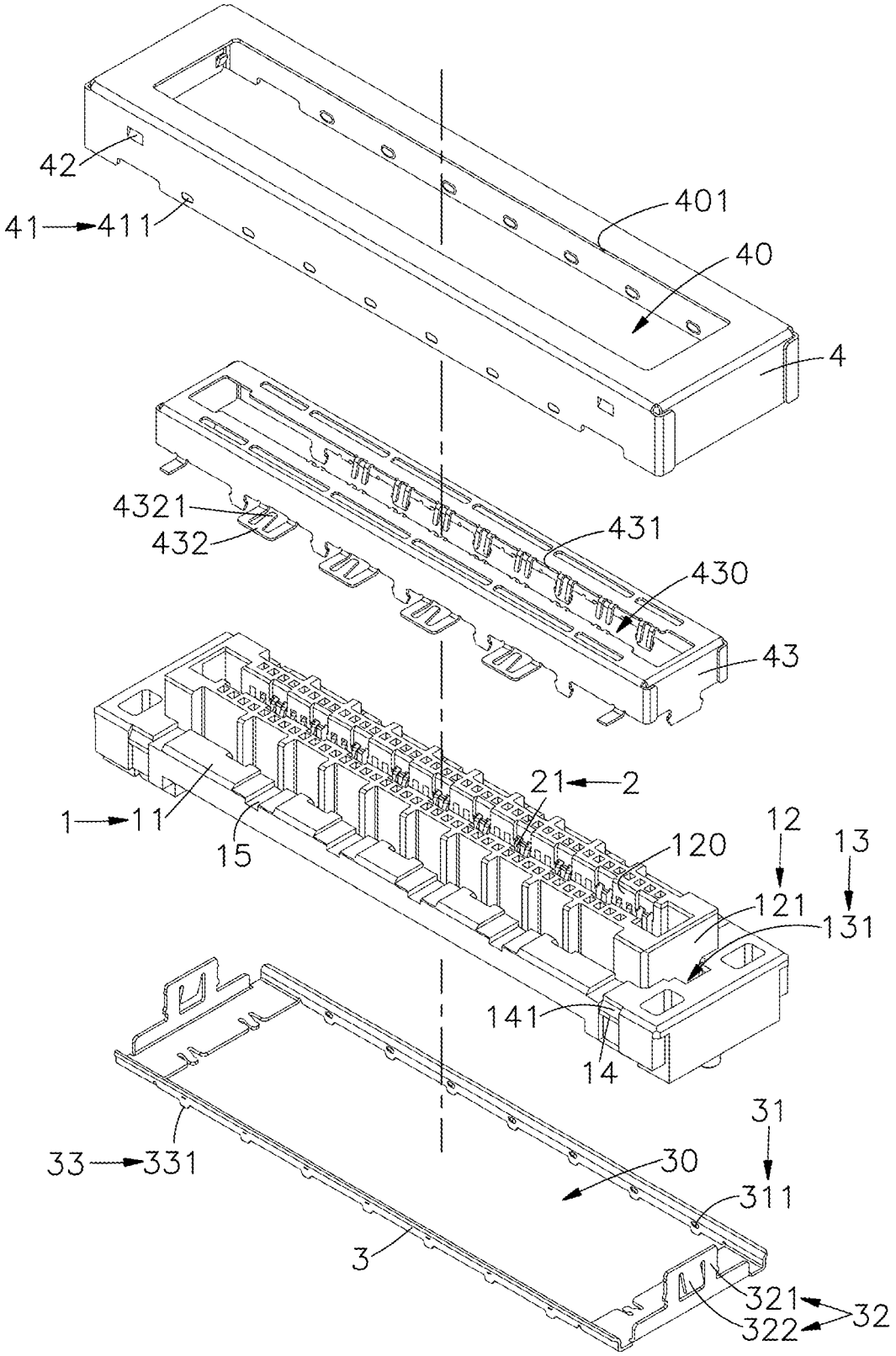
FIG. 2 is an exploded view of the female electrical connector shown in FIG. 1.
Figure 3:
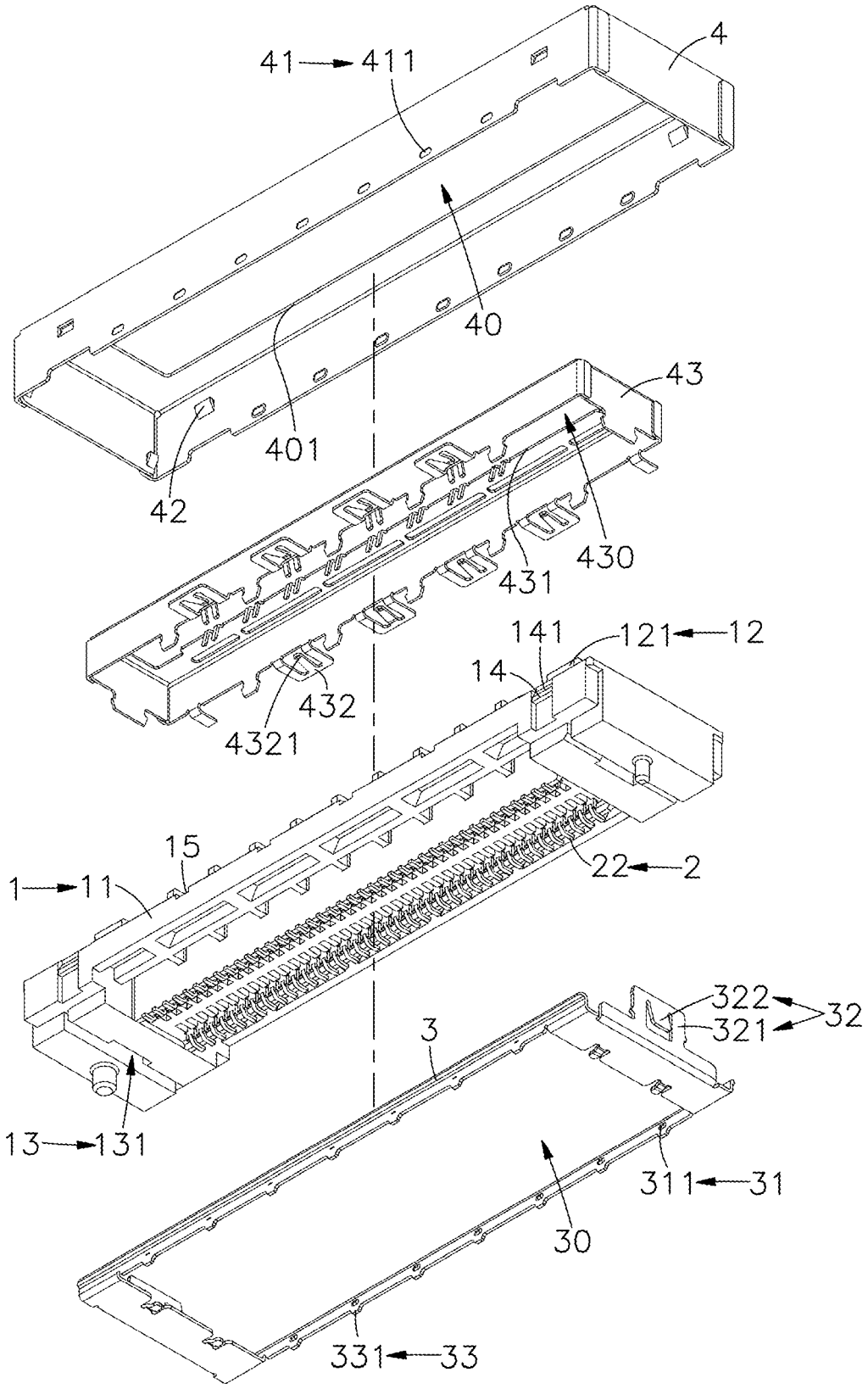
FIG. 3 corresponds to FIG. 2 when viewed from another angle.
Figure 4:
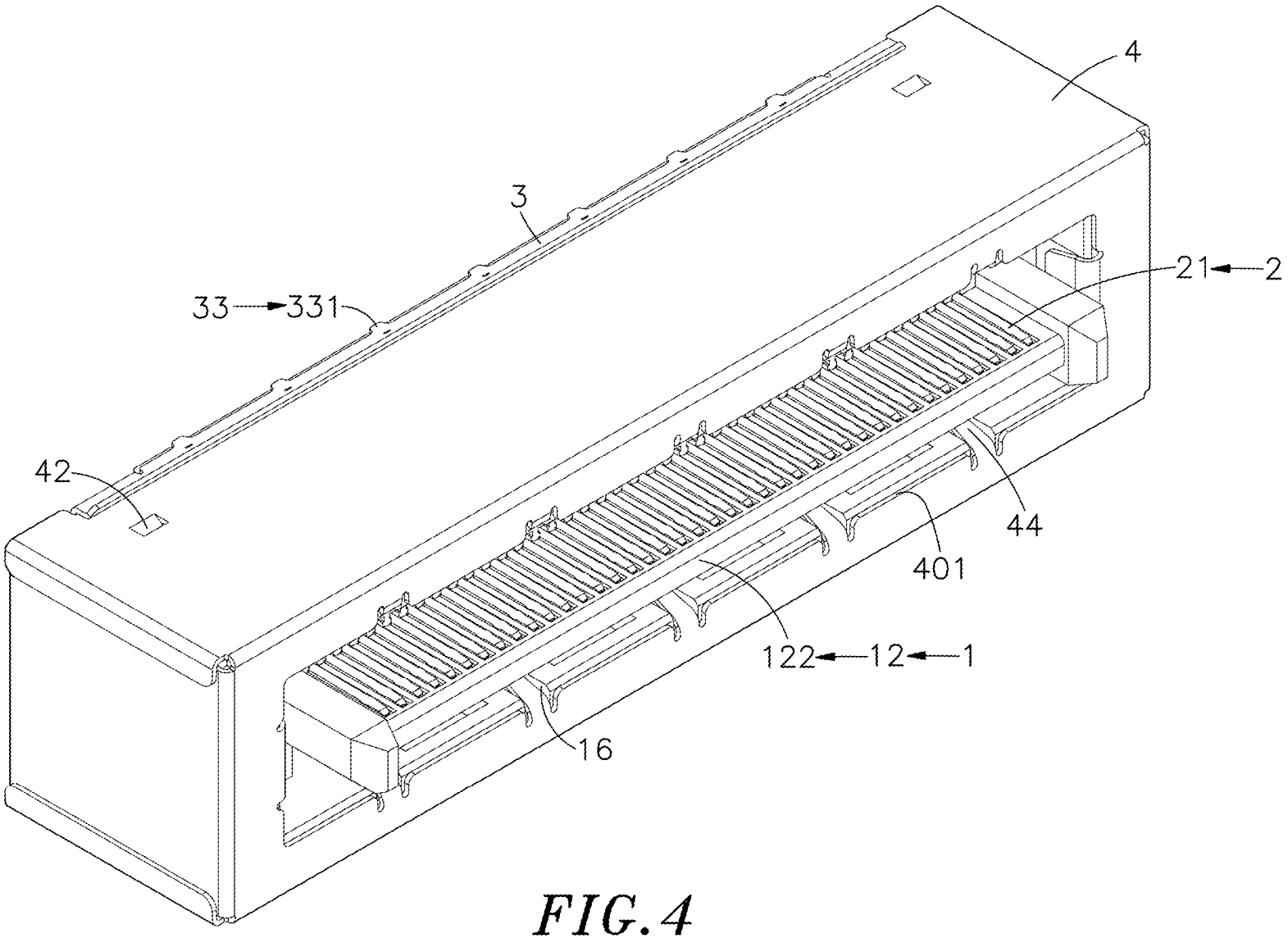
FIG. 4 is an oblique top elevational view of an electrical connector grounding structure in the form of a male electrical connector in accordance with the present invention.
Figure 5:
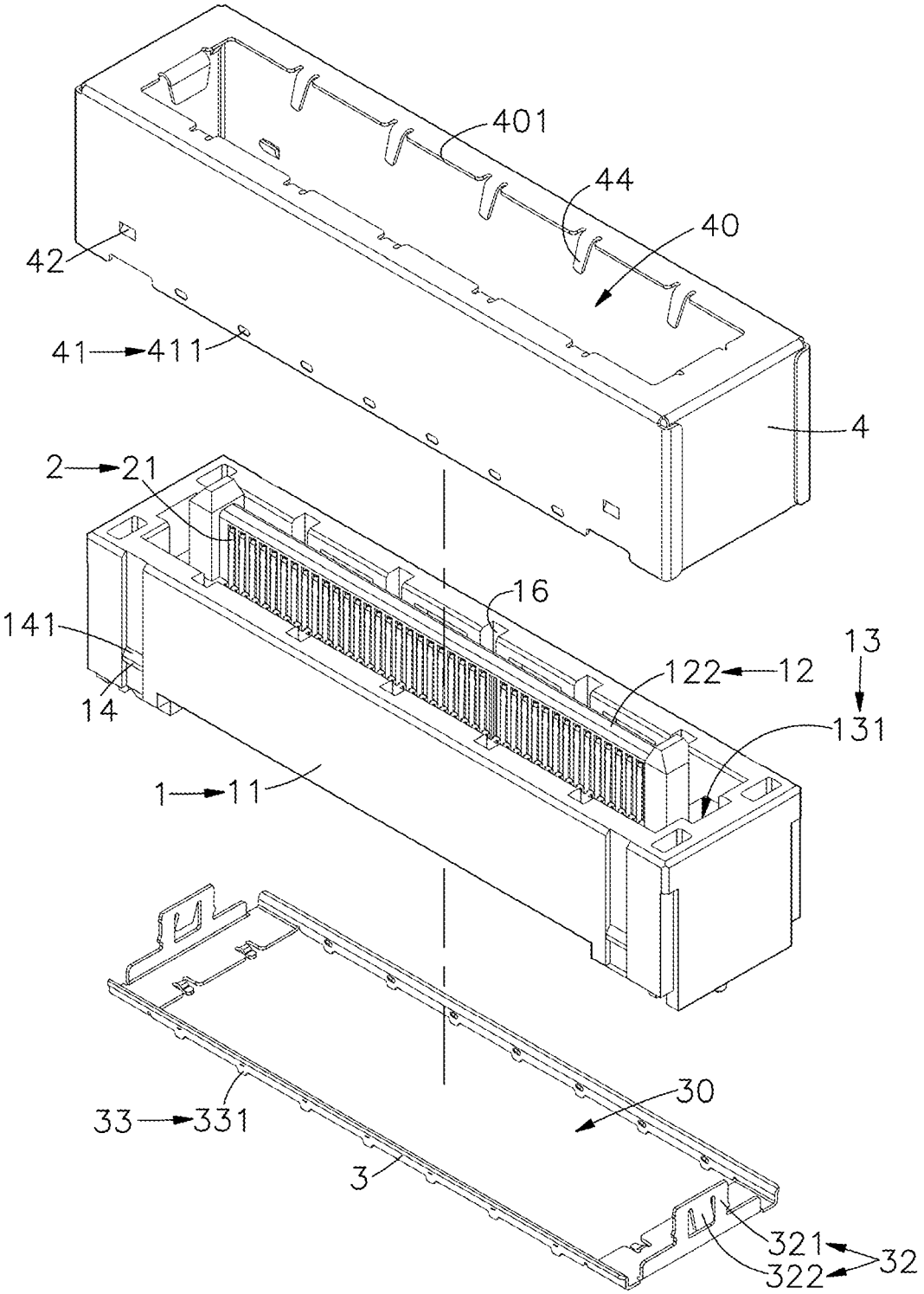
FIG. 5 is an exploded view of the male electrical connector shown in FIG. 4.
Figure 6:
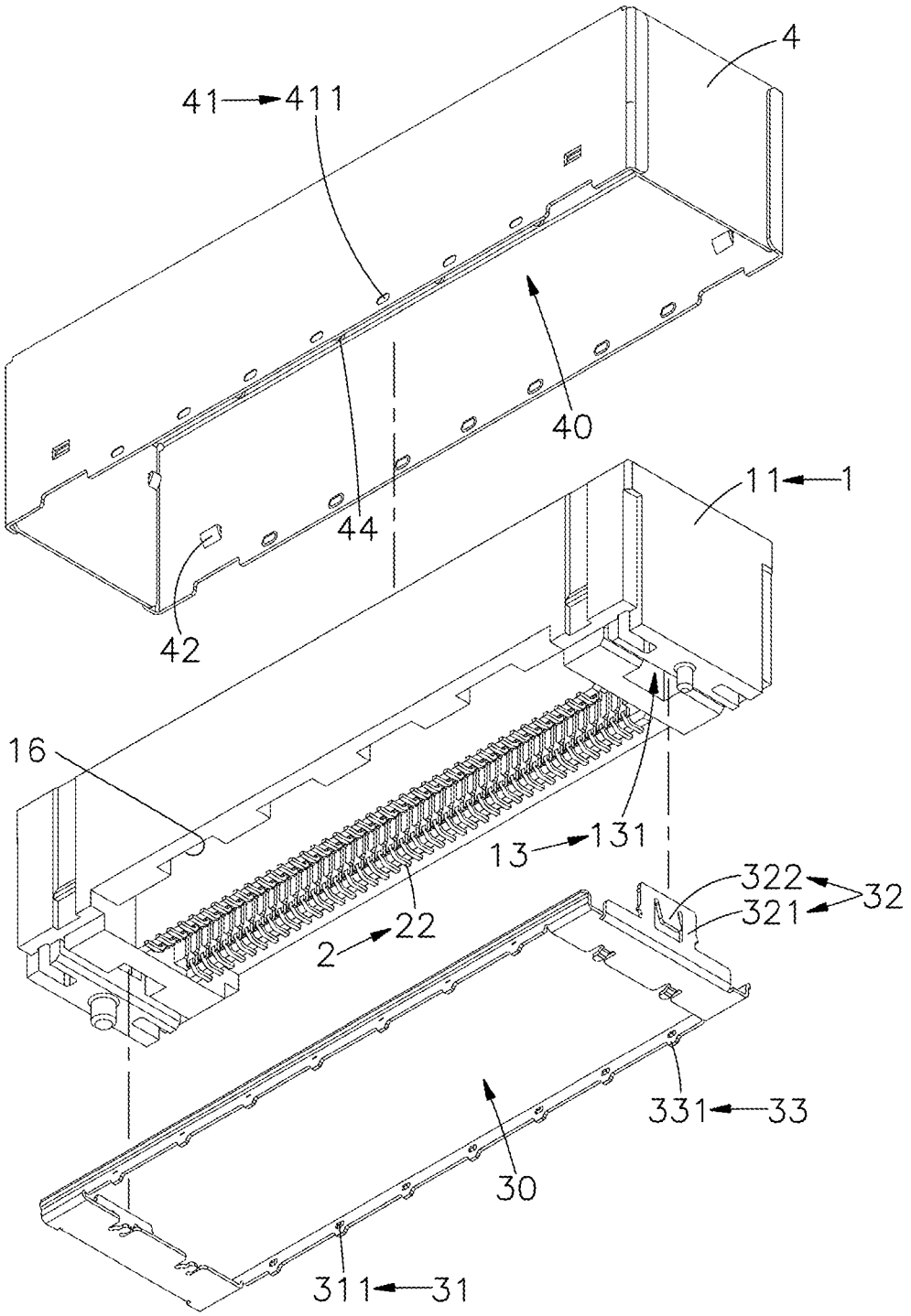
FIG. 6 corresponds to FIG. 5 when viewed from another angle.
Figure 7:
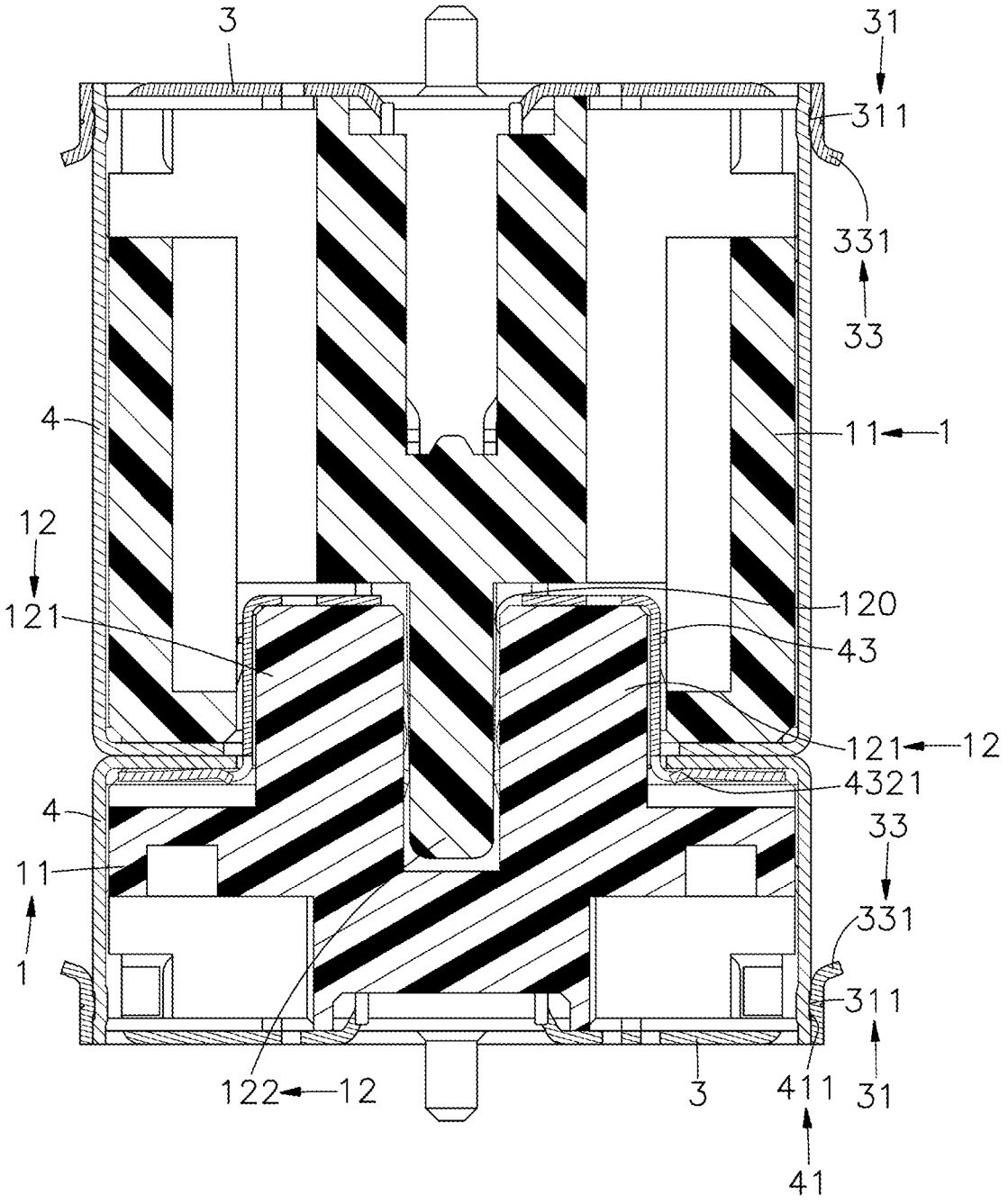
FIG. 7 is a sectional side view, showing the female electrical connector and the male electrical connector connected.
Figure 8:
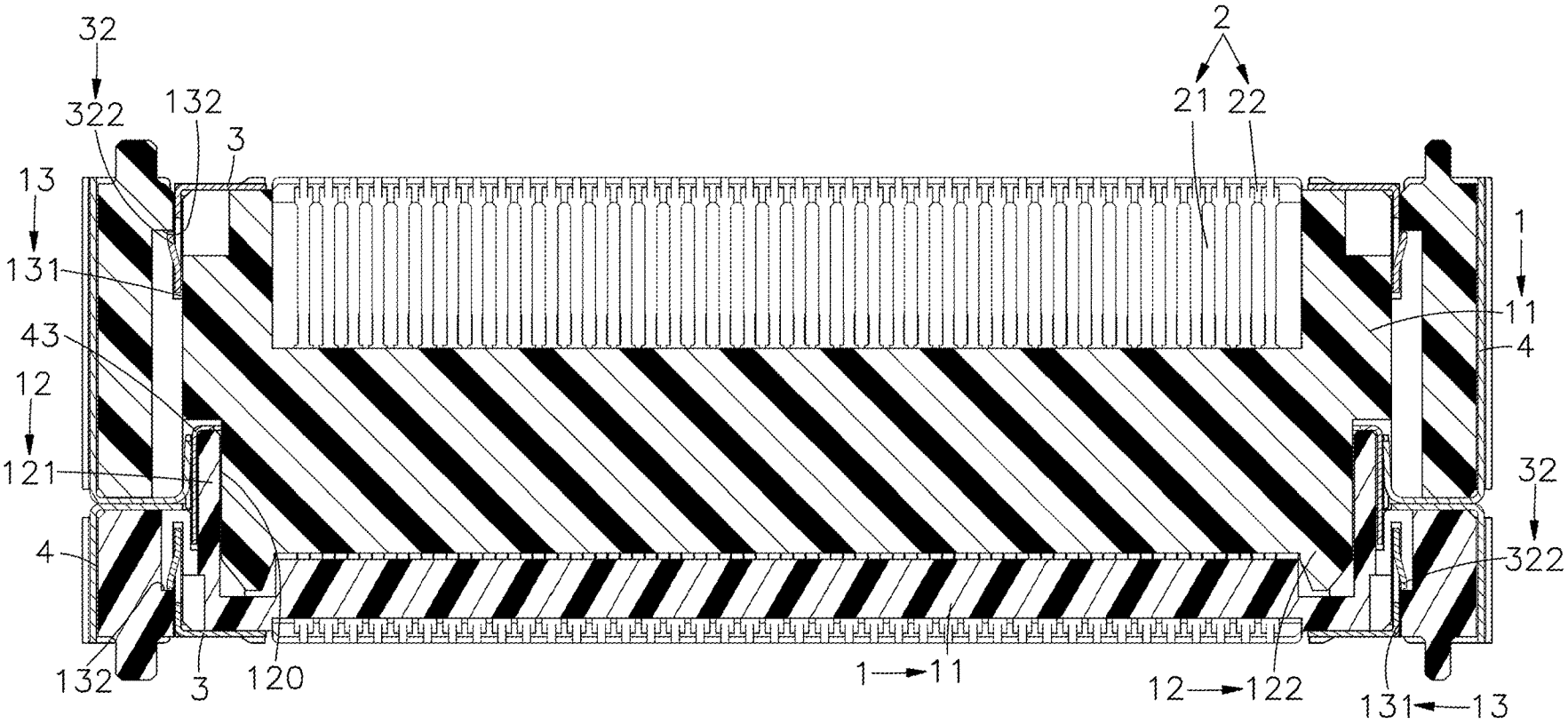
FIG. 8 is another sectional side view, showing the female electrical connector and the male electrical connector connected.

Referring to FIGS. 1-8, an oblique top elevational view of an electrical connector grounding structure in the form of a female electrical connector in accordance with the present invention, an exploded view of the female electrical connector, another exploded view of the female electrical connector, an oblique top elevational view of the electrical connector grounding structure in the form of a male electrical connector, an exploded view of the male electrical connector, another exploded view of the male electrical connector, a sectional side view of the present invention and another sectional side view of the present invention are shown. As illustrated, the present invention comprises an electrically insulative terminal holder block 1, a plurality of conducting terminals 2, a grounding member 3 and a shielding shell 4.

The electrically insulative terminal holder block 1 comprises a rectangular base 11, a mating structure 12 provided on a top surface of the rectangular base 11, a fixing structure 13 provided on the top surface of the rectangular base 11 around the mating structure 12, and a plurality of hook blocks 14 symmetrically formed at opposing front and back sides of the rectangular base 11. The fixing structure 13 comprises two through holes 131 respectively symmetrically located at opposite left and right sides relative to the mating structure 12 and cut through opposing top and bottom surfaces of the rectangular base 11, and a hook groove 132 located in at least one side of the through hole 131. Each hook block 14 has a bevel 141 located at the top thereof.

The conducting terminals 2 each have a contact tip 21 at one end thereof, and a connection tip 22 at an opposite end thereof.

The grounding member 3 comprises a first contact structure 31 and a positioning structure 32 located at a top side thereof, an accommodation open space 30 surrounded by the first contact structure 31 and the positioning structure 32, and a bonding structure 33 located at an opposing bottom side thereof. The first contact structure 31 comprises a plurality of spaced convex contact points 311 located on opposing front and rear inner sides of the grounding member 3 in the accommodation open space 30. The positioning structure 32 comprises two upright plates 321 respectively upwardly extended from opposing left and right sides of the grounding member 3, and a retaining lug 322 protruded from each upright plate 321. The bonding structure 33 comprises at least one bonding strip 331 downwardly extended from the bottom side of the grounding member 3.

The shielding shell 4 comprises an accommodation open chamber 40 formed in a bottom side thereof, an opening 401 located on an opposing top side thereof in communication with the accommodation open chamber 40, a second contact structure 41, which comprises a plurality of spaced contact grooves 411 located on each of opposing front and back sides of the shielding shell 4, and a plurality of hook plates 42 respectively formed on the opposing front and back sides of the shielding shell 4.

In the form of a female electrical connector, the mating structure 12 of the electrically insulative terminal holder block 1 comprises a mating-connection block 121 protruded from a top surface of the rectangular base 11, a mating-connection slot 120 formed in the mating-connection block 121, and a plurality of spaced engagement grooves 15 formed on the top surface of the rectangular base 11 at opposing front and back sides relative to the mating structure 12.

The shielding shell 4 further comprises an inner shell 43. The inner shell 43 comprises an accommodation slot 430 formed therein, a notch 431 longitudinally formed in the accommodation slot 430, and a plurality of contact pieces 432 respectively outwardly extended from opposing front and back sides of a bottom wall thereof. Each contact piece 432 has an upwardly extended contact arm 4321.

When the electrical connector grounding structure of the female electrical connector type is assembled, firstly mount the conducting terminals 2 in the electrically insulative terminal holder block 1 by insert molding, allowing the contact tips 21 of the conducting terminals 2 to be upwardly extended into the mating-connection slot 120 of the mating structure 12 of the electrically insulative terminal holder block 1 and the connection tips 22 of the conducting terminals 2 to be downwardly extended out of the electrically insulative terminal holder block 1. Then, mount the grounding member 3 upwardly to the bottom side of the electrically insulative terminal holder block 1 to insert the two upright plates 321 of the positioning structure 32 of the grounding member 3 into the respective through holes 131 of the fixing structure 13 of the electrically insulative terminal holder block 1, thereby forcing the retaining lugs 322 of the upright plates 321 into engagement with the respective hook grooves 132 in the respective through holes 131 of the fixing structure 13. In this way, the grounding member 3 is firmly assembled on the electrically insulative terminal holder block 1. Thereafter, cap the inner shell 43 on the mating-connection block 121 of the mating structure 12 to accommodate the mating-connection block 121 in the accommodation slot 430 of the inner shell 43, enabling the notch 431 of the inner shell 43 to be aligned with the mating-connection slot 120 of the mating structure 12, and then cap the shielding shell 4 on the rectangular base 11 of the electrically insulative terminal holder block 1 to accommodate the rectangular base 11 in the accommodation open chamber 40 of the shielding shell 4, enabling the mating structure 12 of the electrically insulative terminal holder block 1 and the inner shell 43 to extend out of the accommodation open chamber 40 through the opening 401. At this time, the hook plates 42 of the shielding shell 4 are abutted at the bevels 141 of the respective hook blocks 14 of the electrically insulative terminal holder block 1. Then, bond the connection tips 22 of the conducting terminals 2 and the bonding strips 331 of the bonding structure 33 of the grounding member 3 to the respective contacts of the predetermined circuit board (not shown), and then press down the shielding shell 4 to move the hook plates 42 along the respective bevels 141 into positive engagement with the respective hook blocks 14, enabling the shielding shell 4 to completely cover the connection tips 22 of the conducting terminals 2. At the same time, the convex contact points 311 of the first contact structure 31 of the grounding member 3 are engaged into the respective contact grooves 411 of the second contact structure 41 of the shielding shell 4, and the inner top edge of the accommodation open chamber 40 is kept in contact with the contact arms 4321 the contact pieces 432 of the inner shell 43. In this way, the female electrical connector is completely assembled.

In the case that the electrical connector grounding structure is in the form of a male electrical connector, the mating structure 12 of the electrically insulative terminal holder block 1 comprises a tongue plate 122 located in the rectangular base 11, the rectangular base 11 of the electrically insulative terminal holder block 1 has a plurality of position-limiting grooves 16 located on opposing front and back sides relative to the mating structure 12, and the shielding shell 4 has a plurality of contact components 44 located at opposing front and back sides of the opening 401 of the accommodation open chamber 40.

When the electrical connector grounding structure of the male electrical connector type is assembled, firstly mount the conducting terminals 2 in the electrically insulative terminal holder block 1 by insert molding, allowing the contact tips 21 of the conducting terminals 2 to suspend above and below the tongue plate 122 of the mating structure 12 of the electrically insulative terminal holder block 1 and the connection tips 22 of the conducting terminals 2 to downwardly extend out of the electrically insulative terminal holder block 1. Then, mount the grounding member 1 upwardly to the bottom side of the electrically insulative terminal holder block 1 to insert the two upright plates 321 of the positioning structure 32 of the grounding member 3 into the respective through holes 131 of the fixing structure 13 of the electrically insulative terminal holder block 1, thereby forcing the retaining lugs 322 of the upright plates 321 into engagement with the respective hook grooves 132 in the respective through holes 131 of the fixing structure 13. In this way, the grounding member 3 is firmly assembled on the electrically insulative terminal holder block 1. Thereafter, cap the shielding shell 4 on the rectangular base 11 of the electrically insulative terminal holder block 1 to accommodate the rectangular base 11 in the accommodation open chamber 40 of the shielding shell 4. At this time, the hook plates 42 of the shielding shell 4 are abutted at the bevels 141 of the respective hook blocks 14 of the electrically insulative terminal holder block 1. Then, bond the connection tips 22 of the conducting terminals 2 and the bonding strips 331 of the bonding structure 33 of the grounding member 3 to the respective contacts of the predetermined circuit board (not shown), and then press down the shielding shell 4 to move the hook plates 42 along the respective bevels 141 into positive engagement with the respective hook blocks 14, enabling the shielding shell 4 to completely cover the connection tips 22 of the conducting terminals 2. At the same time, the convex contact points 311 of the first contact structure 31 of the grounding member 3 are engaged into the respective contact grooves 411 of the second contact structure 41 of the shielding shell 4, and the contact components 44 of the shielding shell 4 are inserted into the respective position-limiting grooves 16 of the electrically insulative terminal holder block 1. In this way, the male electrical connector is completely assembled.

In the aforesaid examples, the conducting terminals 2 of the male or female electrical connector are mounted in the electrically insulative terminal holder block 1 using insert molding technology. However, in practical applications, it is not limited to this. The conducting terminals 2 can also be integrated with the insulative terminal holder block 1 by injection molding or assembly according to actual needs or structural design.

Furthermore, the connection tips 22 of the conducting terminals 2 and the bonding strips 331 of the bonding structure 33 of the grounding member 3 can be bonded to the respective contacts of the predetermined circuit board (not shown) using surface mount technology or by through-hole bonding.

When the female electrical connector and the male electrical connector of the present invention are docked with each other, the tongue plate 122 of the mating structure 12 of the electrically insulative terminal holder block 1 of the male electrical connector is inserted into the mating-connection slot 120 of the mating structure 12 of the electrically insulative terminal holder block 1 of the female electrical connector, keeping the contact tips 21 of the conducting terminals 2 of the female electrical connector in contact with the contact tips 21 of the respective conducting terminals 2 of the male electrical connector. At the same time, the shielding shells 4 of the female and male electrical connectors are kept in contact with each other, and the contact components 44 of the male electrical connector are kept in contact with the surface of the inner shell 43 of the shielding shell 4 of the female electrical connector to form a ground loop to improve the path and density of ground conduction, and the grounding members 3 are used to guide out electromagnetic waves and crosstalk interference generated during signal transmission.

The present invention has the following advantages:

(1) The grounding member 3 is mounted on the electrically insulative terminal holder block 1 and kept in contact with the shielding shell 4 to form a common ground loop. When the conducting terminals 2 transmit high-frequency signals, the shielding shell 4 provides a good shielding effect, and the bonding structure 33 of the grounding member 3 guides out the filtered noises to the circuit board to improve the overall grounding, thereby effectively suppressing or filtering the electromagnetic wave interference and crosstalk interference generated during signal transmission and making the overall signal transmission more stable and reliable.

(2) The first contact structure 31 of the grounding member 3 comprises a plurality of convex contact points 311 respectively located at two opposite sides in the accommodation open space 30, and the second contact structure 41 of the shielding shell 4 comprises a plurality of contact grooves 411 for engagement with the convex contact points 311 to improve the stability during contact, and thus achieving the purpose of increasing the stability of the grounding quality.

(3) The shielding shell 4 of the female electrical connector further comprises an inner shell 43 that has a plurality of contact pieces 432 respectively extended from opposing front and back sides of a bottom wall thereof. When the shielding shell 4 is assembled on the electrically insulative terminal holder block 1, the contact pieces 432 of the inner shell 43 are kept in contact with the shielding shell 4 to form a common ground loop that improves the path and density of ground conduction to effectively guide out the electromagnetic wave interference and crosstalk interference generated during signal transmission, thereby making the overall signal transmission more stable and reliable.

(4) When the female electrical connector and the male electrical connector are connected together, the inner shell 43 of the shielding shell 4 of the female electrical connector is kept in contact with the contact components 44 of the shielding shell 4 of the male electrical connector to form a ground loop that improves the path and density of ground conduction to effectively guide out the electromagnetic wave interference and crosstalk interference generated during signal transmission, thereby making the overall signal transmission more stable and reliable.

(5) The shielding shell 4 completely covers the connection tips 22 of the conducting terminals 2 to form a good shielding effect of effectively suppressing or filtering the electromagnetic wave interference and crosstalk interference generated during signal transmission, thereby achieving the purpose of improving the overall signal transmission stability.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector having a grounding structure, comprising:

an electrically insulative terminal holder block comprising a rectangular base, a mating structure located on a top surface of said rectangular base, and a fixing structure located on the top surface of said rectangular base around said mating structure;

a plurality of conducting terminals positioned in said rectangular base of said electrically insulative terminal holder block, each said conducting terminal comprising a contact tip located at one end thereof and extended to said mating structure and a connection tip located at an opposite end thereof and extended out of said electrically insulative terminal holder block, and electrically connected to a predetermined circuit board;

a grounding member mounted on said electrically insulative terminal holder block, said grounding member comprising a first contact structure, a positioning structure positioned in said fixing structure of said electrically insulative terminal holder block and a bonding structure located at a bottom side thereof, and electrically connected to said predetermined circuit board; and a shielding shell comprising an accommodation open chamber that accommodates said electrically insulative terminal holder block, an opening longitudinally formed in said accommodation open chamber for passing of said mating structure and a second contact structure set in contact with said first contact structure.

2. The electrical connector having a grounding structure as claimed in claim 1, wherein said mating structure of said electrically insulative terminal holder block comprises a mating-connection block located in said rectangular base, and a mating-connection slot formed in said mating-connection block for passing of said contact tips of said conducting terminals.

3. The electrical connector having a grounding structure as claimed in claim 2, wherein said mating structure comprises a plurality of spaced engagement grooves formed on a top surface of said rectangular base at opposing front and back sides relative to said mating-connection block; the shielding shell has an inner shell mounted therein, said inner shell comprising an accommodation slot for accommodating said mating-connection block, a notch longitudinally formed in said accommodation slot and kept in alignment with said mating-connection slot and a plurality of contact pieces respectively extended from opposing front and back sides of a bottom wall thereof and respectively positioned in said engagement grooves, each said contact piece having an upward contact arm kept in contact with said shielding shell.

4. The electrical connector having a grounding structure as claimed in claim 1, wherein said mating structure of said electrically insulative terminal holder block comprises a tongue plate located in said rectangular base to support said contact tips of said conducting terminals at opposing top and bottom sides thereof.

5. The electrical connector having a grounding structure as claimed in claim 1, wherein said rectangular base of said electrically insulative terminal holder block comprises a plurality of position-limiting grooves located on opposing front and back sides relative to said mating structure, and said shielding shell comprises a plurality of contact components located at opposing front and back sides of said opening of said accommodation open chamber and respectively positioned in said position-limiting grooves.

6. The electrical connector having a grounding structure as claimed in claim 1, wherein said fixing structure of said electrically insulative terminal holder block comprises two through holes located at opposing left and right sides relative to said mating structure, and a hook groove located in each said through hole; said positioning structure of said grounding member comprises two upright plates respectively located at opposing left and right sides of said grounding member and respectively inserted into said through holes of said fixing structure, each said upright plate comprising a retaining lug engaged in said hook groove in the respective said through hole.

7. The electrical connector having a grounding structure as claimed in claim 1, wherein said electrically insulative terminal holder block further comprises a plurality of hook blocks symmetrically formed at opposing front and back sides of said rectangular base, each said hook block having a bevel; said shielding shell further comprises a plurality of hook plates respectively formed on the opposing front and back sides relative to said accommodation open chamber and respectively hooked on said hook blocks.

8. The electrical connector having a grounding structure as claimed in claim 1, wherein said grounding member comprises an accommodation open space accommodating said electrically insulative terminal holder block; said first contact structure of said grounding member comprises a plurality of spaced convex contact points located at two opposite sides in said accommodation open space; said second contact structure comprises a plurality of spaced contact grooves respectively located at two opposite outer sides of said shielding shell for engagement with said convex contact points.

9. The electrical connector having a grounding structure as claimed in claim 1, wherein said bonding structure of said grounding member comprises at least one bonding strip downwardly extended from the bottom side of said grounding member.

* * * * *